US010751247B2

(12) United States Patent
Walden et al.

(10) Patent No.: US 10,751,247 B2
(45) Date of Patent: Aug. 25, 2020

(54) COMPENSATION FOR DEFLECTION IN AN AUTOMATED CARDIOPULMONARY COMPRESSION DEVICE

(71) Applicant: KONINKLIJKE PHILIPS N.V., Eindhoven (NL)

(72) Inventors: Christopher Walden, Framingham, MA (US); Daniel William Jordan, III, North Reading, MA (US); Paul Aelen, Eindhoven (NL); Virginia Higley, Tyngsboro, MA (US); Tyler Smith, Eindhoven (NL); Steve Frankovich, Eindhoven (NL); Dan Canfield, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 740 days.

(21) Appl. No.: 15/039,154

(22) PCT Filed: Nov. 24, 2014

(86) PCT No.: PCT/IB2014/066287

§ 371 (c)(1),
(2) Date: May 25, 2016

(87) PCT Pub. No.: WO2015/075696

PCT Pub. Date: May 28, 2015

(65) Prior Publication Data

US 2017/0156977 A1 Jun. 8, 2017

Related U.S. Application Data

(60) Provisional application No. 61/908,224, filed on Nov. 25, 2013.

(51) Int. Cl.
*A61H 31/00* (2006.01)

(52) U.S. Cl.
CPC ... *A61H 31/006* (2013.01); *A61H 2201/5007* (2013.01); *A61H 2201/5046* (2013.01);
(Continued)

(58) Field of Classification Search
CPC ..... A61H 31/006; A61H 2201/5092; A61H 2201/5084; A61H 2201/5082;
(Continued)

(56) References Cited

U.S. PATENT DOCUMENTS

| | | | | |
|---|---|---|---|---|
| 8,560,065 | B2 | 10/2013 | Eerden | |
| 8,942,803 | B1 * | 1/2015 | Herken | A61N 1/3925 607/5 |
| 9,585,603 | B2 | 3/2017 | Centen | |
| 9,707,151 | B2 | 7/2017 | Woerlee | |
| 2005/0080360 | A1 * | 4/2005 | Katz | A61H 31/005 601/44 |
| 2005/0209543 | A1 | 9/2005 | Palmer et al. | |
| 2008/0097257 | A1 * | 4/2008 | Stromsnes | A61H 31/00 601/41 |

(Continued)

FOREIGN PATENT DOCUMENTS

EP 1913922 A2 4/2008

*Primary Examiner* — Quang D Thanh

(57) ABSTRACT

A cardio-pulmonary compression system includes a compression device (110), a supporting mechanism (120) coupled to the compression device and a feedback sensor (104) configured to measure interactions between a patient and the compression device. A control unit (112) is configured to receive input from the feedback sensor and adjust operating parameters of the compression system to meet a target parameter during operation of the compression device.

3 Claims, 5 Drawing Sheets

(52) U.S. Cl.
CPC ..... *A61H 2201/5048* (2013.01); *A61H 2201/5058* (2013.01); *A61H 2201/5061* (2013.01); *A61H 2201/5064* (2013.01); *A61H 2201/5082* (2013.01); *A61H 2201/5084* (2013.01); *A61H 2201/5092* (2013.01)

(58) Field of Classification Search
CPC .... A61H 2201/5064; A61H 2201/5058; A61H 2201/5048; A61H 2201/5046; A61H 2201/5007; A61H 2201/5061; A61H 31/004; A61H 31/005; A61H 2205/084; A61H 2203/0456; A61H 2201/0157; A61H 2201/1207; A61H 2201/123; A61H 2201/1619; A61H 2201/1621; A61H 2201/1664; A61H 2201/50
See application file for complete search history.

(56) References Cited

U.S. PATENT DOCUMENTS

| | | | | |
|---|---|---|---|---|
| 2008/0097534 | A1* | 4/2008 | Myklebust ..... | A61H 31/00 607/5 |
| 2010/0004571 | A1* | 1/2010 | Nilsson ..... | A61H 31/006 601/41 |
| 2010/0049266 | A1* | 2/2010 | Ochs ..... | A61H 31/005 607/5 |
| 2010/0198118 | A1 | 8/2010 | Itnati | |
| 2012/0016279 | A1* | 1/2012 | Banville ..... | A61H 31/004 601/41 |
| 2013/0226049 | A1 | 8/2013 | Kandori | |
| 2013/0324894 | A1* | 12/2013 | Herken ..... | A61H 31/006 601/41 |
| 2014/0323928 | A1* | 10/2014 | Johnson ..... | A61H 31/005 601/41 |

* cited by examiner

COMPENSATION FOR DEFLECTION IN AN AUTOMATED CARDIOPULMONARY COMPRESSION DEVICE

This application is a national stage application under 35 U.S.C. § 371 of International Application No. PCT/IB2014/066287 filed on Nov. 24, 2014 and published in the English language on May 28, 2015 as International Publication No. WO/2015/075696, which claims priority to U.S. Application No. 61/908,224 filed on Nov. 25, 2013, the entire disclosures of which are incorporated herein by reference.

BACKGROUND

Technical Field

This disclosure relates to cardiopulmonary instruments and more particularly to methods and devices for automatic cardiopulmonary resuscitation (CPR) systems.

Description of the Related Art

Mechanical cardiopulmonary resuscitation (CPR) devices have switched from pneumatic devices to electro-mechanically powered compression mechanisms. These devices use battery powered motors and provide precise control and adjustability of compression rate and depth. The American Heart Association (AHA) and the European Resuscitation Council (ERC) have each established best-practice guidelines for cardiopulmonary resuscitation. A key variable specified by both is the depth of compressions. To reach the specified depth of chest compression, a significant amount of force is required. In addition, the amount of force required to reach the specified depth varies from patient to patient.

Mechanical CPR devices currently on the market may be divided into two configurations. These include rigid structure devices and chest-mounted devices.

For rigid structure devices, the chest compression mechanism or "chest compressor" is suspended above the patient using a rigid frame or structure, with a rigid backboard underneath the patient. These devices usually have some means of height adjustment to accommodate patients of different sizes. In rigid structure devices, although the chest compressor's stroke distance with respect to the chest compressor's housing can be tightly controlled by the drive mechanism's control system, the actual compression depth applied to the patient can be substantially less than the therapy depth range specified in the AHA and ERC guidelines. A significant portion of this error in patient compression depth can be attributable to the mechanical deflection of the support structure and backboard, due to the high compression forces required for adequate perfusion. This inadequate compression depth may result in adverse patient outcomes.

For chest-mounted devices, the chest compression mechanism or "chest compressor" is directly supported by and rests atop the patient's chest, and flexible straps and/or belts (hereafter "straps") are used to affix the compression device to the patient. These devices may or may not utilize a rigid backboard underneath the patient. In chest-mounted devices, although the chest compressor's stroke distance with respect to the chest compressor's housing can be tightly controlled by the drive mechanism's control system, there are a number of reasons why the chest compressor may lift up off the patient's chest. When this happens, the actual compression depth received by the patient can be substantially less than the intended compression depth. Inadequate compression depth may result in adverse patient outcomes.

There are a number of potential sources of lift-off. It is up to the caregiver to sufficiently tighten the straps to ensure that the chest compressor is properly secured. If not done correctly, this could result in chest compressor lift-off. The chest compressor may also lift up off the patient's chest due to physiological changes in the patient's chest during therapy, including, but not limited to a change in the cross-sectional shape (e.g., "chest molding" or "compression set") and/or changes in the relative stiffness of the chest. In addition, while the compressor's stroke may be the primary source of these changes, the straps themselves, due their shape, position, and tension, may also contribute to this effect. In these scenarios, while the straps and chest compressor may have been secure at the start of therapy, they may begin to loosen, and the chest compressor may begin to lift off the chest as compression therapy progresses. During compressions, the straps will carry a tensile load corresponding to the compression load applied to the patient. The tensile stiffness of the straps, a function of the straps' material and construction, will determine how much the straps stretch during compressions. This stretch will also contribute to the chest compressor lifting off the patient's chest.

SUMMARY

In accordance with the present principles, a cardio-pulmonary compression system includes a compression device, a supporting mechanism coupled to the compression device and one or more feedback sensors configured to measure interactions between a patient and the compression device. A control unit is configured to receive input from the one or more feedback sensors and adjust operating parameters of the compression system to meet a target parameter during operation of the compression device.

Another cardio-pulmonary compression system includes a compression device and a supporting mechanism coupled to the compression device. One or more feedback sensors are configured to measure interactions between a patient and the compression device. A control unit is configured to receive input from the one or more feedback sensors and adjust operating parameters of the compression system to meet a target parameter during operation of the compression device using a dynamic adjustment module stored in memory and configured to output an adjustment signal in accordance with measurements from the one or more feedback sensors. At least one adjustment mechanism is configured to be responsive to the adjustment signal to make adjustments to the compression system to achieve the target parameter.

A method for dynamic adjustment of a cardio-pulmonary compression system, includes correlating measured sensor data for the compression system with a resulting compression depth for one or more types of patients; creating a reference index for the measured sensors data against a desired compression depth for different patient types; during operation of the compression system, measuring sensor data; comparing the sensor data to the reference index to determine one or more adjustment settings to the compression system needed to achieve a target parameter; and adjusting one or more adjustment mechanisms in accordance with the one or more adjustment settings to achieve the target parameter.

These and other objects, features and advantages of the present disclosure will become apparent from the following detailed description of illustrative embodiments thereof, which is to be read in connection with the accompanying drawings.

BRIEF DESCRIPTION OF DRAWINGS

This disclosure will present in detail the following description of preferred embodiments with reference to the following figures wherein.

DETAILED DESCRIPTION OF EMBODIMENTS

Figure 1A:
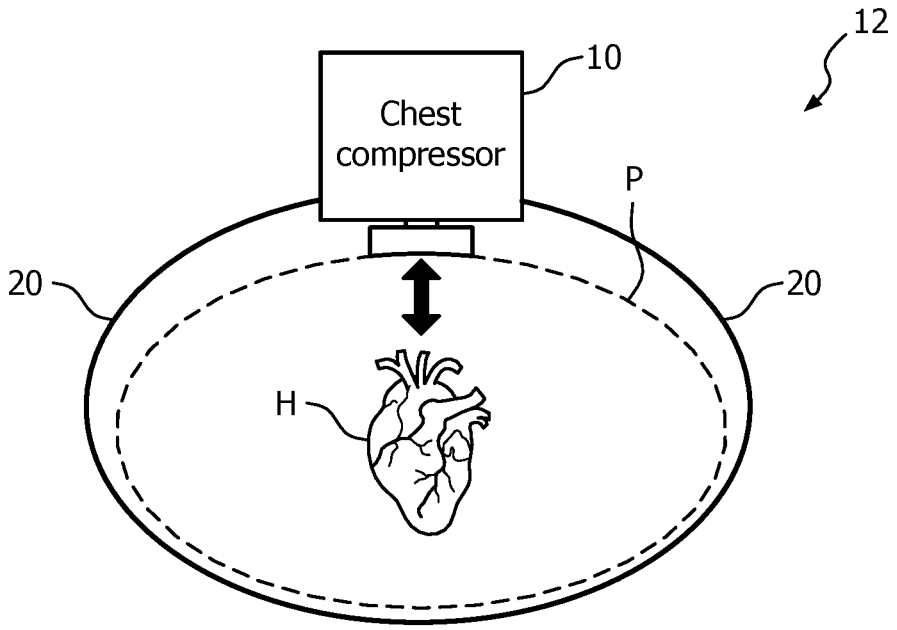
FIG. 1A is a schematic cross-sectional view showing an automated chest compression system having a chest-mounted structure.
Figure 1B:
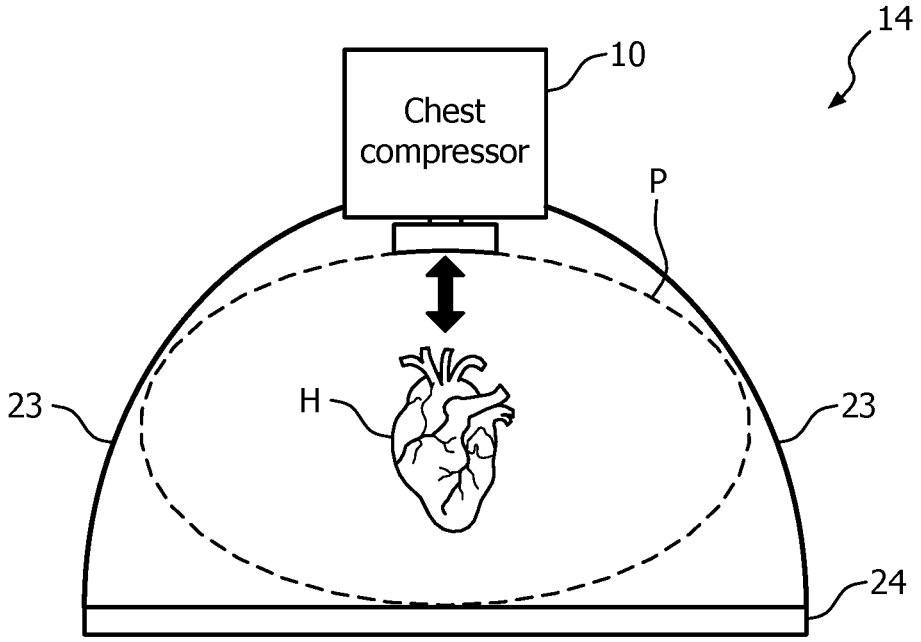
FIG. 1B is a schematic cross-sectional view showing another automated chest compression system having a chest-mounted design with a backboard.

In accordance with the present principles, systems, devices, and methods for detection of and compensation for variable structural deflection and/or compression device movement in cardiopulmonary resuscitation (CPR) devices are provided to permit more consistent and reliable delivery of the full compression depth to a patient. Mechanical cardiopulmonary compression devices provide many clinical and practical advantages over manual CPR. As per 2010 guidelines from the American Heart Association (AHA), the CPR compression rate should be, e.g., at least 100 compressions per minute with a depth of at least 5 centimeters (for adults). Studies have found that manual CPR is frequently performed too slowly and without adequate depth to ensure good perfusion. In addition, even if manual compressions are performed to AHA guidelines, caregivers usually tire quickly. Mechanical CPR devices are intended to provide compressions consistent with AHA guidelines over long periods of time.

In designs where the compression device is suspended above the patient using a rigid frame or structure, with a backboard underneath the patient, mechanical deflection of both the structure and backboard due to the force of compressions can lead to inadequate depth of compression therapy. In designs where the compression device is directly supported by and rests atop the patient's chest, flexible straps and/or belts are employed to affix the compression device to the patient. Under certain circumstances, the chest compressor may lift up off the chest ("lift-off"), reducing the depth of compression therapy delivered to the patient.

The present principles address these issues and provide a patient sensitive dynamic approach, which customizes treatment in accordance with feedback from sensors. This provides detection and compensation for variable structural deflections and/or compression device movements to provide more consistent and reliable delivery of compressions to the patient.

It should be understood that the present invention will be described in terms of medical instruments; however, the teachings of the present invention are much broader and are applicable to training equipment, and any other instrument that employs automatic compressions. In some embodiments, the present principles are employed in providing compressions for complex biological or mechanical systems.

The elements depicted in the FIGS. may be implemented in various combinations of hardware and software and provide functions which may be combined in a single element or multiple elements. The functions of the various elements shown in the FIGS. can be provided through the use of dedicated hardware as well as hardware capable of executing software in association with appropriate software. When provided by a processor, the functions can be provided by a single dedicated processor, by a single shared processor, or by a plurality of individual processors, some of which can be shared. Moreover, explicit use of the term "processor" or "controller" should not be construed to refer exclusively to hardware capable of executing software, and can implicitly include, without limitation, digital signal processor ("DSP") hardware, read-only memory ("ROM") for storing software, random access memory ("RAM"), non-volatile storage, etc.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the block diagrams presented herein represent conceptual views of illustrative system components and/or circuitry embodying the principles of the invention. Similarly, it will be appreciated that any flow charts, flow diagrams and the like represent various processes which may be substantially represented in computer readable storage media and so executed by a computer or processor, whether or not such computer or processor is explicitly shown.

Furthermore, embodiments of the present invention can take the form of a computer program product accessible from a computer-usable or computer-readable storage medium providing program code for use by or in connection with a computer or any instruction execution system. For the purposes of this description, a computer-usable or computer readable storage medium can be any apparatus that may include, store, communicate, propagate, or transport the program for use by or in connection with the instruction execution system, apparatus, or device. The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W), Blu-Ray™ and DVD.

Referring now to the drawings in which like numerals represent the same or similar elements and initially to FIGS.

1A and 1B, cross-sectional views of chest-mounted compression devices 12 and 14 are illustratively shown to be employed in accordance with the present principles. Each of devices 12, 14 includes a chest compressor 10 that rests directly on a chest of a patient P over a heart H. A strap 20 of device 12 is wrapped around patient P and coupled to sides of chest compressor 10. The strap 20 of device 12 extends around the sides and back of the patient P. Straps 23 of device 14 extend over sides of the patient P and connect the compressor device 10 with a rigid structure or backboard 24.

Other structures are also contemplated. For example, sections of the strap 20 or straps 23 may be replaced by one or more rigid or semi-rigid lengths of material, which may be attached to the chest compressor 10, attached to the backboard 24, or attached to neither one.

Figure 2A:
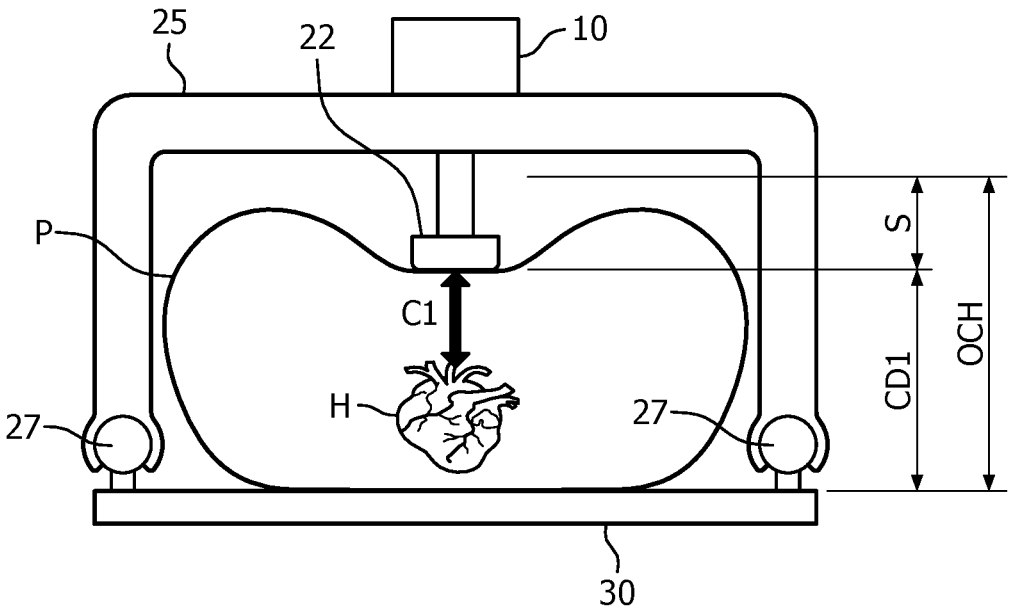
FIG. 2A is a schematic cross-sectional view showing an automated chest compression system during a compression stroke for a rigid structure design.
Figure 2B:
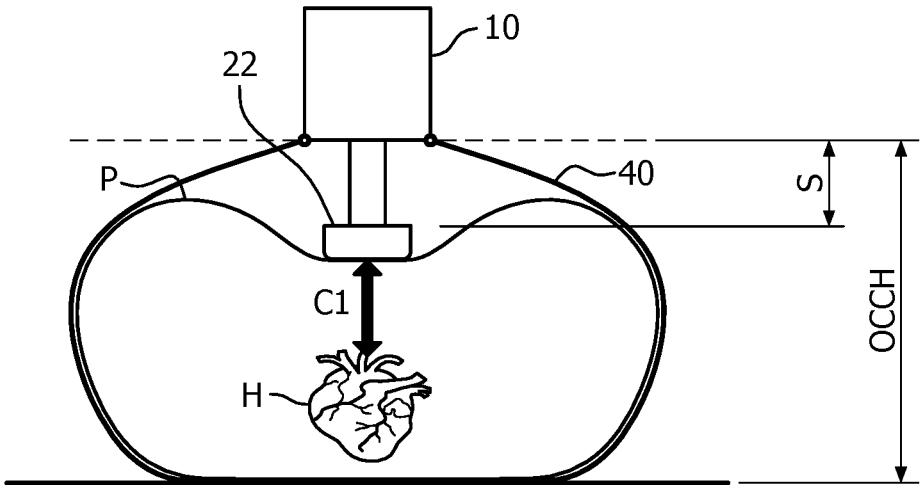
FIG. 2B is a schematic cross-sectional view showing an automated chest compression system during a compression stroke for a chest-mounted design.

Referring to FIGS. 2A and 2B, a rigid structure (FIG. 2A) and a chest-mounted device (FIG. 2B) include chest compressors 10 after initiating compressions.

In FIG. 2A, a rigid structure mechanical CPR device has been placed on patient P. The patient P is placed on top of a rigid backboard 30. A compressor 10 is attached to a support structure 25 and has been placed over the patient and connected to the backboard 30 by joints 27. In an initial configuration (not shown), the compressor's moving pad 22 is resting against the patient's chest, and is uncompressed. The distance between the top of the patient's chest and the top of the backboard 30 is the "original chest height" OCH.

If the backboard 30 and support structure 25 are "infinitely rigid", i.e., they do not bend or deflect under mechanical load, 100% of compressor stroke S is applied to compressing the patient's chest, so that chest compression distance C1=S. CD1=OCH−S. Of course, real-life materials are not infinitely rigid, so not all of the compressor's stroke S is applied toward compressing the patient's chest.

In FIG. 2B, a chest-mounted chest compressor 10 is attached to the patient P by a wrap-around belt or strap 40. In its initial configuration (not shown), the chest compressor's moving pad 22 is resting uncompressed against the patient's chest. The distance between the top of the patient's chest and compressor housing is the "original chest compressor height" OCCH.

A full chest compression with perfectly tight, secure straps 40 would provide 100% of the compressor stroke S to compress the patient's chest, so that chest compression distance C1=S. Of course, "perfectly tight" is not a real-life condition, so not all of the compressor's stroke S is applied to compressing the patient's chest.

Figure 3A:
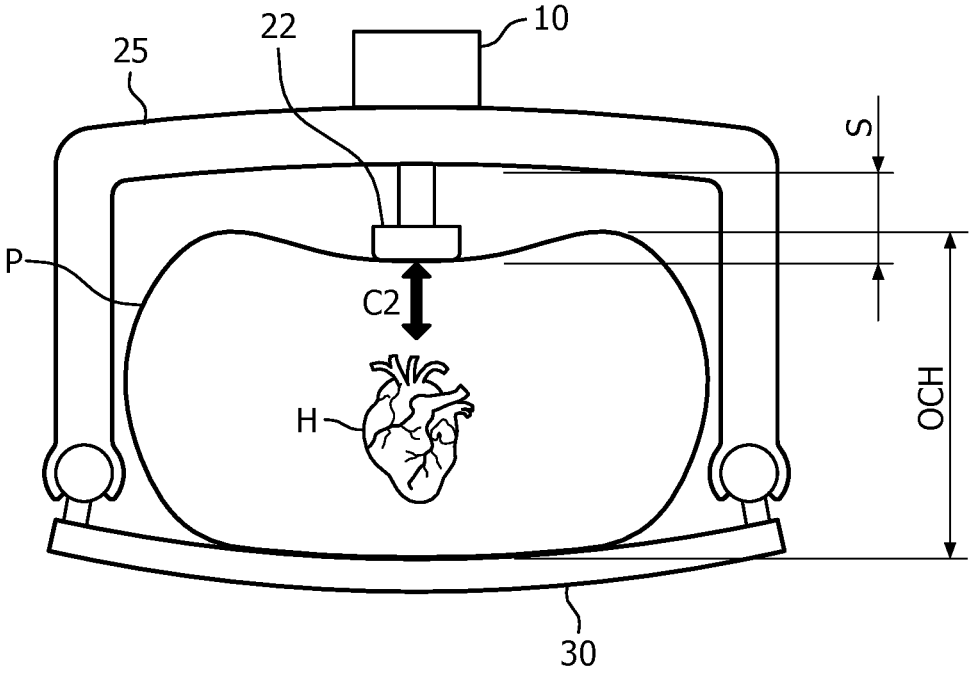
FIG. 3A is a schematic cross-sectional view showing stroke error for an automated chest compression system during a compression stroke for a rigid structure design.
Figure 3B:
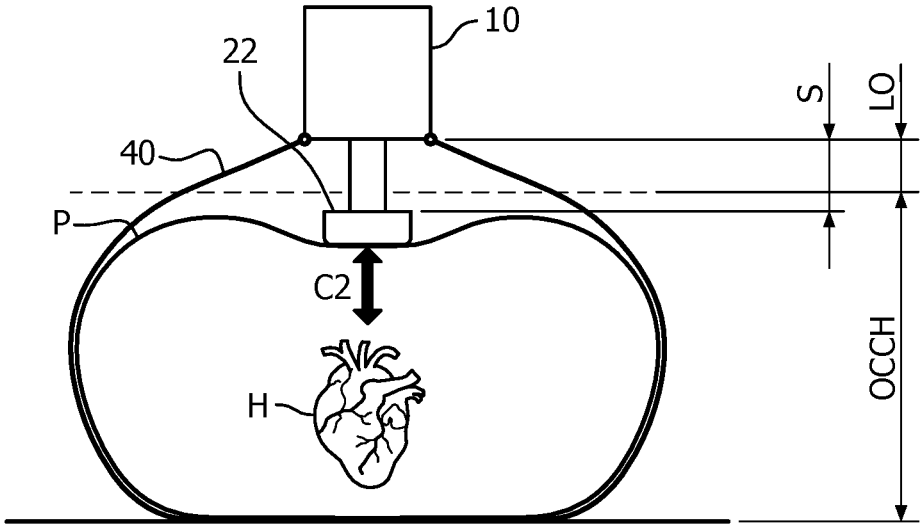
FIG. 3B is a schematic cross-sectional view showing stroke error for an automated chest compression system during a compression stroke for a chest-mounted design.

Referring to FIGS. 3A and 3B, chest compression configurations experience loss due to less than infinite rigidity and/or stretch in straps. In FIG. 3A, the rigid structure includes real-world materials such that when the compressor is fully extended the stroke distance S, the force that results from compressing the patient's chest causes the backboard 30 and support structure 25 to bend and deflect. The combined deflection of these components results in the compressor 10 lifting up off the patient P. While much of compressor stroke displacement S is applied to compressing the patient's chest, some percentage is applied to deflecting the mechanical CPR components. As a result, chest compression distance C2<S, and the full amount of compressor stroke S is not applied to the patient P.

In FIG. 3B, the chest-mounted configuration includes a scenario where the strap 40 is not fully secured or has loosened, and the chest compressor 10 has lifted off the patient's chest by a distance LO. As a result, chest compression distance C2<S, and the full amount of compressor stroke S is not applied to the patient P.

A method for minimizing the "C2<S error" may include minimizing the mechanical deflection by increasing the stiffness of the system components. In rigid structure devices, while deflection can be reduced by virtue of part design and the material selections, increasing stiffness can lead to increased weight and/or increased costs. Neither of these is desirable from a caregiver point of view. The ability to minimize deflection is even more limited in chest-mounted devices, due to the inherent flexibility of the straps and the conformability of the patient's body.

Another method for compensating for these deflections and the resulting error is to build in a fixed offset value into the distance that the compressor plunger travels. If 5 cm of compression needs to be delivered to the patient, then move the plunger 5.5 or 6 cm, allowing compensation for a total of 0.5 or 1 cm of structural deflection. While a fixed offset value would work well for a fixed compression force value, in reality the compression force needed to achieve a fixed compression depth varies significantly from patient to patient, resulting in a range of possible structural deflections. As a result, the compression depth delivered to the patient may or may not be as intended when using a fixed offset value. CPR protocols may specify different compression depths for different patient types and situations. This additional variable demands a more rigorous control of compression depth, rendering the fixed offset method even more inadequate.

In accordance with the present principles, one or more sensors are provided to detect and quantify system deflection and/or chest compressor movement, enabling the system to dynamically compensate for variable structural deflections and/or lift-off, providing a much more reliable and predictable compression depth delivery to the patient, regardless of the relative stiffness of the patient's chest or the depth of compression.

Figure 4:
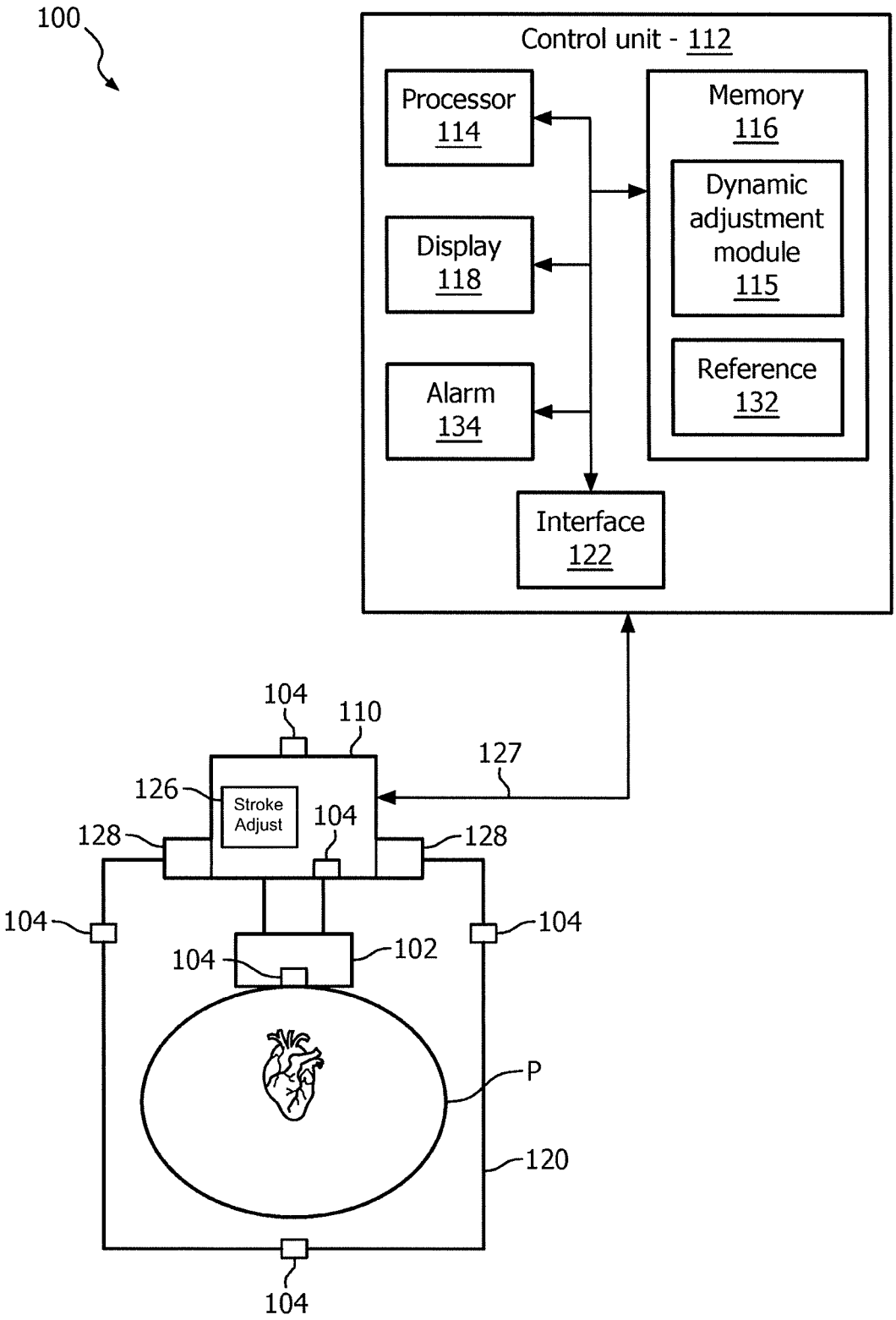
FIG. 4 is a block/flow diagram showing a system for delivering automated compressions in accordance with one embodiment.

Referring to FIG. 4, a system 100 for delivering automated compressions is illustratively shown in accordance with one embodiment. System 100 is depicted generically to include a compression device 110 coupled to a securing mechanism 120. The securing mechanism 120 may include a rigid structure, flexible straps, straps with rigid positions, etc. The system 100 includes a control unit or controller 112 from which a procedure is supervised and/or managed. Control unit 112 preferably includes one or more processors 114 and memory 116 for storing programs and applications. Memory 116 may store algorithms or methods in a dynamic adjustment module 115 configured to interpret feedback signals from one or more sensors 104 mounted on or in the compression device 110 and/or the patient securing mechanism 120.

The dynamic adjustment module 115 is configured to use the signal feedback from the sensors 104 to measure forces, deformations, deflections and/or other changes associated with compressions imparted by the compression device 110. The dynamic adjustment module 115 may be stored in memory 116 within the control unit 112 or externally to the control unit 112.

The compression device 110 is connected to the control unit 112 via one or more cables 127 that carry electrical power, sensor information, control signals, etc., or they may be connected wirelessly. The control unit 112 and the compression device 110 may be located together within one shared housing, or they may be located in separate housings. The sensors 104, etc. may be connected to the control unit 112 by wired cabling 127 or through wireless connections.

The cabling 127 may include fiber optics, electrical connections, other instrumentation, etc., as needed.

The control unit 112 may include a personal computer, an application specific hardware device having software components, a handheld computing device or any other suitable control unit. The control unit 112 may include or be connected to a display device 118. Control unit 112 includes the display 118 for viewing, among other things, measured data, providing controls, displaying a status or setting, etc. Display 118 may also permit a user to interact with the control unit 112 and its components and functions, or any other element within the system 100. This is further facilitated by an interface 122 which may include a keyboard, mouse, a joystick, a haptic device, touch screen, microphone (e.g., for voice recognition) or any other peripheral or control to permit user feedback from and interaction with the control unit 112.

The securing mechanism 120 may include a rigid structure where the compression device 110 is secured to the patient P using a backboard (30) and support structure as described earlier. The securing mechanism 120 may include a chest-mounted device where the compression device 110 is secured to the patient P by a strap as described earlier. One or more sensors 104 are employed in and/or attached to the compression device 110 to detect and quantify forces, system deflection and/or chest compressor movement. A compression pad 102 that is in contact with the patient may have sensors 104 located therein. The securing mechanism 120 may also include a sensor or sensors 104. Other sensors and sensor positions are also contemplated.

As the control unit 112 monitors and processes outputs from the sensors 104, the dynamic adjustment module 115 assesses the degree of movement, force, deflection, etc. If appropriate, the control unit 112 may then make adjustments to adjustment mechanisms 126, 128 to, e.g., increase the chest compressor stroke distance an appropriate amount using mechanism 126 to compensate for any system deflection or lift-off of the compression device 110. This will result in the patient receiving the full chest compression intended. Alternatively or in addition to this, in a chest-mounted device, the control unit 112 may activate one or more strap tensioning mechanisms 128 to tighten the straps and reduce the amount of compression device lift-off. The control unit 112 may implement other actions to ensure proper stroke values are achieved by the compression device 110. For example, an offset or other corrective actions may be implemented in a number of ways. For example, the dynamic response module 115 may utilize a continuous formula to calculate a continuously variable compressor stroke offset in accordance with measured feedback from the sensors 104. In another embodiment, the dynamic response module 115 may utilize a "look up table" of discrete offset values for small, incremental sensor value ranges, and do so continually against measured feedback from the sensors 104. In yet another embodiment, the dynamic response module 115 may utilize a maximum sensor value measured on a previous stroke or averaged over a number of previous strokes to determine the offset value for the current stroke. A reference index 132 may be employed to store data in a data structure (e.g., the lookup table, formula, stored thresholds, etc.) to permit the dynamic adjustment module 115 to make comparisons between measured sensor data and desired results (e.g., compression depth).

If the dynamic response module 115 determines that the amount of deflection or lift-off is excessive, possibly resulting in inadequate chest compression depth, an alarm 134 or notice may be activated to notify the caregiver, so that they may assess whether further corrective action is needed. The alarm 134 may include an audio or light device.

The compression device 110 may include a plurality of same or different sensors 104 to provide feedback to the dynamic response module 115. In one example, a compression force sensor is employed which measures and/or calculates the force applied to the patient P. Any number of different sensor types or force calculation methods may be utilized, including, but not limited to strain gauge—based sensor(s), piezoelectric sensor(s), capacitive sensor(s), optical sensor(s) to measure deflection of one or more system components and correlate that to force values, deflection measurement sensors, e.g., a spring with a known spring rate, which is positioned between the patient and a motor drive mechanism of the compression device 110, a motor current sensor and/or a power measurement sensor employed to correlate measurements to a force value, gyroscopic sensors, accelerometers, temperature sensors, strap tension sensors, which measure tensile force(s) in the straps, etc. Temperature sensors may be utilized to enable compensation for system deflections that are influenced by temperature or for other purposes.

In a rigid structure device, for any given backboard and support structure design, the bending and deflection characteristics of each structure as a function of force applied can be very predictable and may easily be determined. These forces and deflection correlations to these forces may be made in advance of employing the system 100. Once the correlations are determined, these force-deflection characteristics can be incorporated into the dynamic response module 115. As the control unit 112 monitors the force value measured in the compression device 110, the dynamic response module 115 determines resulting expected backboard and support structure deflections and may then take appropriate actions to ensure sufficient stroke length for CPR compressions for an individual patient.

In a chest-mounted device, the dynamic response module 115 can compare the compression force measured to values expected as a function of compressor stroke position and may then take appropriate actions to ensure sufficient stroke length for CPR compressions for an individual patient.

In one embodiment, the compression device 110 may include one or more accelerometers and/or gyroscopes for sensors 104. The one or more accelerometers and/or gyroscopes can continuously detect the movement of the chest compressor in one or more degrees of freedom. As the dynamic response module 115 of the control unit 112 monitors these movement values, appropriate actions can be taken to ensure sufficient stroke length for CPR compressions for an individual patient. The accelerometer and/or gyroscope data may be employed to detect and compensate for additional system conditions such as patient orientation and/or movement, such as during patient transport.

It should be understood that a system 100 may include different combinations and numbers of sensors 104 (e.g., combinations of strain gauges, force sensors, accelerometers, gyroscopes, etc.). The dynamic response module 115 may employ multiple sensor inputs to determine appropriate corrective actions.

Figure 5:
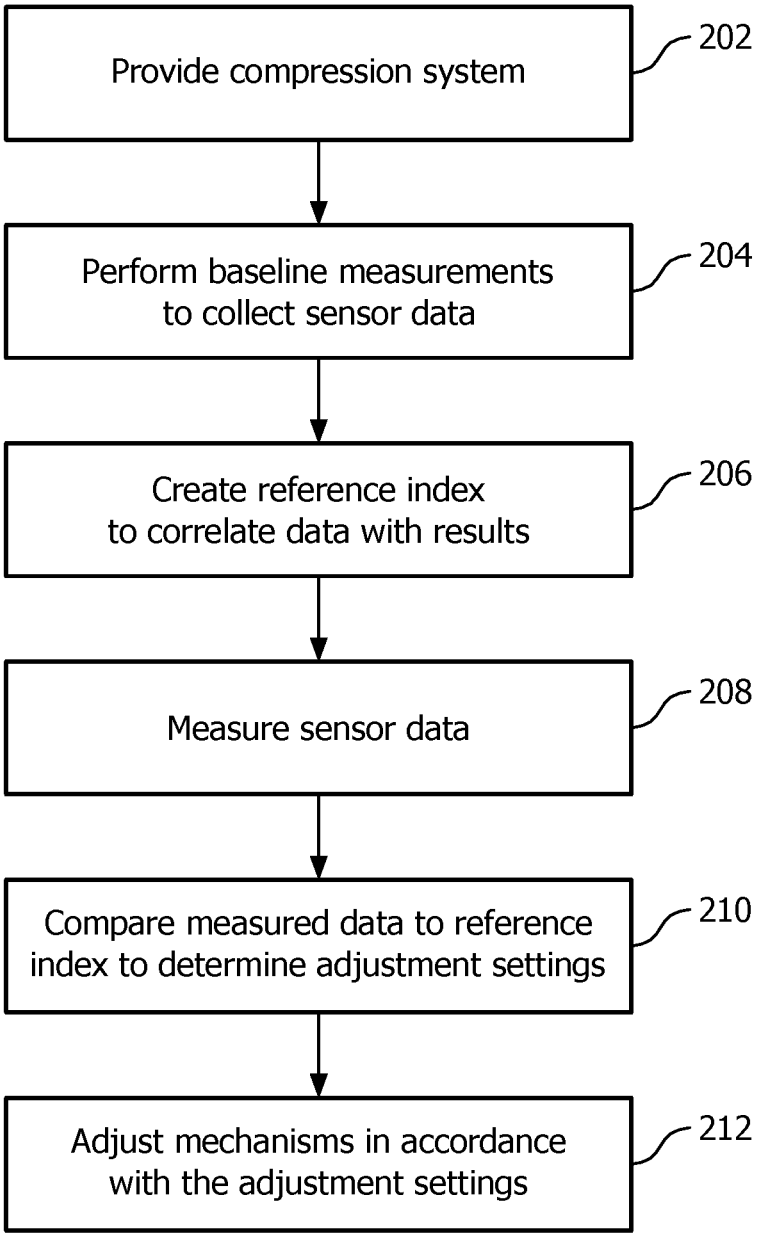
FIG. 5 is a flow diagram showing a method for dynamic adjustment of a cardio-pulmonary compression system in accordance with an illustrative embodiment.

Referring to FIG. 5, a method for dynamic adjustment of a cardio-pulmonary compression system is shown in accordance with illustrative embodiments. In block 202, a compression system is provided having one or more feedback sensors provided thereon. The sensors may include force sensors, deflections sensors, accelerometers, etc. The sensors may be located in or on the compression device, in or on rigid structures or straps, etc. In block 204, a baseline measurement or measurements are performed to correlate measured sensor data for the compression system with a resulting compression depth for one or more types of patients. This may include use of models, cadavers, and/or materials that simulate structure and resilience of a human body. Different types or classes of models, etc. may be employed so that different body types, age groups (adult versus child) or any other variation for potential patients can be measured.

In block 206, a reference index is created for the measured sensors data against a desired compression depth for the different patient types. The reference index may include a lookup table (or other data structure), a formula for computing adjustment parameters based upon measured inputs; measured values for previous compression cycles, etc.

In block 208, during operation of the compression system, sensor data is measured. In block 210, the sensor data that is measured is compared to the reference index to determine one or more adjustment settings for the compression system needed to achieve a target parameter. In block 212, one or more adjustment mechanisms are adjusted in accordance with the one or more adjustment settings to achieve the target parameter (e.g., compression depth). The adjustments may include adjustments to at least one of a stroke length of a compression device, a strap tension, etc. to achieve the target parameter, which may include a compression depth of the compression device.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function; and e) no specific sequence of acts is intended to be required unless specifically indicated.

Having described preferred embodiments for compensation for deflection in an automated cardiopulmonary compression device (which are intended to be illustrative and not limiting), it is noted that modifications and variations can be made by persons skilled in the art in light of the above teachings. It is therefore to be understood that changes may be made in the particular embodiments of the disclosure disclosed which are within the scope of the embodiments disclosed herein as outlined by the appended claims. Having thus described the details and particularity required by the patent laws, what is claimed and desired protected by Letters Patent is set forth in the appended claims.

The invention claimed is:

1. A cardio-pulmonary compression system, comprising:

an automated compression device configured to apply a compressive force to a chest of a patient;

a supporting mechanism coupled to the automated compression device and configured to mount the automated compression device on the chest of the patient, the supporting mechanism undergoing deflection under the compressive force applied to the chest of the patient and/or permitting lift-off of the automated compression device from the chest of the patient under the compressive force applied to the chest of the patient;

one or more feedback sensors configured to measure the deflection of the supporting mechanism and/or the lift-off of the automated compression device under the compressive force; and a control unit configured to receive input from the one or more feedback sensors and adjust operating parameters of the compression system to compensate for the deflection of the supporting device mechanism and/or the lift-off of the automated compression device to meet a target chest compression parameter during operation of the automated compression device, wherein the control unit includes one or more processors configured to:

during operation of the compression system to compress the chest of the patient, measure the sensor data from the one or more feedback sensors, correlate the measured sensor data with a resulting compression depth for different types of patients, create a reference index for the measured sensor data against a desired compression depth for the different patient types, compare the measured sensor data to the reference index to determine one or more adjustment settings to achieve a target compression depth, control the compression device in accordance with the one or more adjustment settings to compress the chest of the patient.

2. A cardio-pulmonary compression system comprising:

a compression device operable to extend a compression plunger to compress a chest of a patient;

a supporting mechanism coupled to the compression device to position the compression device on the chest of the patient, wherein the supporting mechanism includes a strap;

one or more feedback sensors configured to measure interactions between a the patient and the compression device, including deflection of the supporting mechanism and/or lift-off of the compression device during the operation of the compression device;

a control unit configured to receive input from the one or more feedback sensors and adjust extension of the compression plunger of the compression system to meet a target compression distance during operation of the compression device using an output from the one or more feedback sensors to make adjustments to the compression system to compensate for the deflection of the supporting mechanism and/or lift-off of the compression device during the operation of the compression device to achieve the target compression distance; and a dynamic adjustment module configured to adjust a tension of the strap in accordance with the one or more feedback sensors.

3. A cardio-pulmonary compression system, comprising:

a compression device configured to compress a chest of a patient;

a support mechanism configured to support the compression device on the chest of the patient;

one or more sensors configured to measure deformation of the supporting mechanism and/or lift-off of the compression device during operation of the compression device and generate sensor data indicative thereof;

one or more processors configured to:

during operation of the compression system to compress the chest of the patient, measure the sensor data, correlate the measured sensor data with a resulting compression depth for different types of patients, create a reference index for the measured sensor data against a desired compression depth for the different patient types, compare the measured sensor data to the reference index to determine one or more adjustment settings to achieve a target compression depth, control the compression device in accordance with the one or more adjustment settings to compress the chest of the patient.

* * * * *